US006053131A

United States Patent [19]

Mueller et al.

[11] Patent Number: 6,053,131

[45] Date of Patent: Apr. 25, 2000

[54] HEAT EXCHANGER FOR LIQUID HEAT EXCHANGE MEDIA

[75] Inventors: Ludwig Mueller, Munich; Martin Brielmair, Erding; Christian Absmeier, Margarethenried, all of Germany

[73] Assignee: Bayerische Motoren Werke Aktiengesellschaft, Munich, Germany

[21] Appl. No.: 09/058,809

[22] Filed: Apr. 13, 1998

[30] Foreign Application Priority Data

Apr. 12, 1997 [DE] Germany ..... 197 15 324

[51] Int. Cl.[7] ..... F01P 1/06

[52] U.S. Cl. ..... 123/41.31; 123/41.33; 123/196 AB

[58] Field of Search ..... 123/41.1, 41.29, 123/41.31, 41.33, 196 AB

[56] References Cited

U.S. PATENT DOCUMENTS

| | | | |
|---|---|---|---|
| 2,070,092 | 2/1937 | Ramsaur | 123/196 R |
| 2,392,723 | 1/1946 | Chandler | 213/41.33 |
| 2,435,041 | 1/1948 | Hild | 123/178 |
| 2,670,933 | 3/1954 | Bay | 123/41.33 |
| 4,535,729 | 8/1985 | Faylor | 123/41.1 |
| 4,726,325 | 2/1988 | Itakura | 123/41.1 |
| 5,215,044 | 6/1993 | Banzhaf et al. | 123/41.29 |

FOREIGN PATENT DOCUMENTS

| | | |
|---|---|---|
| 0 499 071 | 8/1992 | European Pat. Off. . |
| 2 571 431 | 4/1986 | France . |
| 7 66 237 | 4/1952 | Germany . |
| 9 46 932 | 8/1956 | Germany . |
| 19 26 034 | 9/1965 | Germany . |
| 23 47 038 | 3/1975 | Germany . |
| 25 23 436 | 12/1976 | Germany . |
| 36 08 294 | 9/1987 | Germany . |
| 87 02 534 | 8/1988 | Germany . |
| 38 17 952 | 11/1989 | Germany . |

*Primary Examiner*—Noah Kamen
*Attorney, Agent, or Firm*—Evenson, McKeown, Edwards & Lenahan, P.L.L.C

[57] ABSTRACT

A heat exchanger for liquid heat exchange media for alternate valve-controlled heating or cooling of one of the liquids, to achieve high-quality regulation of a valve device and small temperature differentials between the inlet and outlet of the heat exchange means that serves for heating and cooling. A temperature sensor is provided in the outlet of the heat exchanger for the first liquid or heat exchange means that serves for heating and cooling. The sensor controls and/or regulates separate valves located in a hot inlet and a cold inlet of the first liquid or of the first heat exchange means in the valve device.

16 Claims, 2 Drawing Sheets

HEAT EXCHANGER FOR LIQUID HEAT EXCHANGE MEDIA

BACKGROUND AND SUMMARY OF THE INVENTION

This application claims the priority of German patent document 197 15 324,0, filed Apr. 12, 1997, the disclosure of which is expressly incorporated by reference herein The present invention relates to a heat exchanger for liquid heat exchange media, especially for different fluids in separate circuits, primarily in internal combustion engines. More particularly, the invention relates to a heat exchanger which is supplied at its inlet with flows of a first liquid at different temperatures for alternate heating or cooling of the second liquid under valve control. A valve device located at the inlet is controlled as a function of an outlet temperature of one of the liquids.

A system of the type generally described above in a heat exchanger for an internal combustion engine is known, for example, from U.S. Pat. No. 2,670,933. In this known system, during warm-up of the internal combustion engine, the entire internal coolant flow is conducted through the water/lubricating oil/heat exchanger. When the internal combustion engine is subjected to a high load, an external cooling circuit is connected by a thermostatic valve, with all of the coolant being cooled down being fed back through the water/lubricating oil/heat exchanger of the engine. In an intermediate temperature range, the internal cooling circuit and the external cooling circuit of the engine are coupled together through an additional valve. This valve is designed as a three-way valve, and, depending on the temperature of the lubricating oil flowing out of the water/lubricating oil/heat exchanger, is controlled to produce a flow into the water/lubricating oil/heat exchanger that is a mixture of cold and hot coolant components.

To detect the lubricating oil temperature, an electrical temperature sensor can be used to produce signals which serve to control a positioning motor that is in a driving connection with the three-way valve. In another embodiment, the lubricating oil can be fed to a thermostatic device that is in a driving connection with the three-way valve. There is a significant risk that, in the event of damage to such an arrangement, each of the liquids can cross over into the other circuit of the engine and cause the engine to fail. Both systems are also costly to construct.

This disadvantage is overcome by a valve device located at the inlet of a water/oil heat exchanger as proposed in German patent document P 196 37 817. This device is composed of a hot inlet that is connected with the internal coolant circuit in a bypass flow and with a cold inlet that is connected with an air/water heat exchanger In internal combustion engines with a low heat impact during a warm-up phase, in order to enable the heating and air-conditioning system to begin operating quickly, the hot inlet is controlled by a thermostatic throttle valve and the cold inlet is controlled by a separate thermostatic valve. In internal combustion engines with a high heat impact during warm-up, instead of the two separately acting thermostatic valves, a single thermostatic valve in the valve device upstream from the water/oil heat exchanger can control the two intake lines. In order to reliably control the temperatures of lubricating and/or transmission oil over the entire operating range of the engine with this single thermostat, the operating opening temperature and the regulating temperature of this thermostat must be switched to cool operation. The operating opening temperature thus determined for the single thermostat, however, is disadvantageously low for warming up one or more oils using the water/oil heat exchanger. Consequently, during warm-up, the engine receives, from the water/oil heat exchanger, relatively cold coolant in the internal cooling circuit that is operable during the warm-up phase. This results in a disadvantage, since engine warm-up is delayed.

A goal of the intention is to design a coolant control for a heat exchanger such that, during the warm-up phase, the temperature of the coolant that flows out can be favorably adjusted to the temperatures of devices connected further downstream in the cooling circuit.

This and other goals have been achieved according to the present invention by providing a heat exchanger for liquid heat exchanger media in an internal combustion engine which has at least two different liquids in separate circuits. The heat exchanger is exposed on an inlet side to a plurality of flows of a first of the liquids. These flows are at different temperatures for alternate heating or cooling of a second of the liquids under valve control. A valve device located on the inlet side is controlled as a function of a temperature of one of the liquids on the outlet side. A temperature sensor is located in an outlet of the heat exchanger for the first liquid, serving for heating and cooling, for control and/or regulation of separate valves located in a hot inlet and a cold inlet for the first liquid in the valve device.

This and other goals have also been achieved according to the present invention by providing a cooling system for a motor vehicle, including a coolant cooler, i.e., a radiator, having an inlet communicating with an internal combustion engine via a coolant return line. A valve device has a hot inlet, communicating with the coolant return line, and a cold inlet communicating with an outlet of the coolant cooler. A coolant/oil heat exchanger has a coolant inlet communicating with an outlet of the valve device. A coolant outlet communicates with the internal combustion engine via an engine coolant supply line. A temperature sensor disposed in the engine coolant supply line controls the valve device to regulate a relative proportion of incoming coolant flow into the valve device from the hot inlet and from the cold inlet, This and other goals have additionally been achieved according to the present invention by providing a cooling system for a motor vehicle, including a valve device having a hot inlet communicating with a coolant return line from an is internal combustion engine, and a cold inlet communicating with a coolant cooler, i.e., a radiator. A coolant/oil heat exchanger has a coolant inlet communicating with an outlet of the valve device. A coolant outlet communicates with an engine coolant supply line. A temperature sensor disposed in the engine coolant supply line controls the valve device to regulate a relative proportion of incoming coolant flow into the valve device from the hot inlet and from the cold inlet.

This and other goals have further been achieved according to the present invention by providing a method of controlling a cooling system for a motor vehicle including a coolant cooler, i.e., a radiator, having an inlet communicating with an internal combustion engine via a coolant return line, a valve device having a hot inlet communicating with the coolant return line and a cold inlet communicating with an outlet of the coolant cooler, and a coolant/oil heat exchanger having a coolant inlet communicating with an outlet of the valve device and a coolant outlet communicating with the internal combustion engine via an engine coolant supply line. The method includes the acts of arranging a temperature sensor in the engine coolant supply line, and controlling the valve device with the temperature sensor in order to regulate a relative proportion of incoming coolant flow into the valve device from the hot inlet and from the cold inlet.

According to the invention, a temperature sensor is provided in the outlet from the heat exchanger for the first liquid that serves for heating and cooling. The temperature sensor is provided for the control and regulation of separate valves located in a hot inlet and in a cold inlet for the first liquid in the valve device.

In the system according to the invention composed of a temperature sensor in the outlet of the heat exchanger, the temperature sensor is advantageously impacted by a coolant that has been optimally mixed, resulting in much smaller temperature fluctuations. In addition, the operating opening point can advantageously be set higher by comparison with heat exchanger input regulation. This has the advantage that the coolant in the outlet of the water/oil heat exchanger is at a higher temperature, so that the temperature of the coolant flowing out of the heat exchanger during the warm-up phase advantageously can be raised to the temperature of the coolant circulating in the internal cooling circuit. Engine warm-up time is thus significantly reduced.

In certain preferred embodiments of the invention, a wax-filled expansion element with a rod-type piston is provided as the temperature sensor, with the piston having two valve plates located at a distance from the expansion element such that with each maximum stroke of the piston, one valve plate is in the open position and the other valve plate is in the closed position. As a result, a simple valve device of advantageous design is produced. This device, in certain embodiments, is preferably made in the form of a separate part with an outlet located between the valves, through which the valve device can be tightly connected with the inlet to the heat exchanger. A piston, that may be formed by coupling two sections, links the valve device with the expansion element located in the heat exchanger outlet. This design allows simple assembly and avoids problems with the operation of the valves.

The heat exchanger according to the invention is preferably used for alternate heating and cooling of an oil for a drive assembly by means of the coolant in an internal combustion engine equipped with a coolant thermostat. The hot inlet of the valve device is connected with a coolant bypass on the engine, and the cold inlet of the valve device is connected with a low-temperature cooler located in the coolant circuit of the engine. In this design, when an oil is cooled by means of the water/oil heat exchanger, especially intensive cooling of the oil or oils is achieved.

In addition, the invention is preferably used for heating and cooling the transmission oil of the drive assembly. In addition, with a temperature sensor located for example in the transmission oil sump of the engine, the signals from this sensor can be used to control an electrical heating element located in the wax of the expansion element. The system, therefore, is configured to quickly move the expansion element, which is set for a higher operating opening temperature as well as a higher regulating temperature, into the open position as a function of the oil temperature reached in the transmission sump. With this system, the temperature of the coolant that flows out in the warm-up phase of the water/oil heat exchanger advantageously has nearly the same temperature as the coolant circulating in the bypass.

In another embodiment of the invention, the valves of the valve device are connected in a driving relationship either individually or jointly with a positioning motor. The valve or valves are controlled by amplified signals from an electrical/electronic temperature sensor.

Other objects, advantages and novel features of the present invention will become apparent from the following detailed description of the invention when considered in conjunction with the accompanying drawings.

DETAILED DESCRIPTION OF THE DRAWINGS

Figure 1:
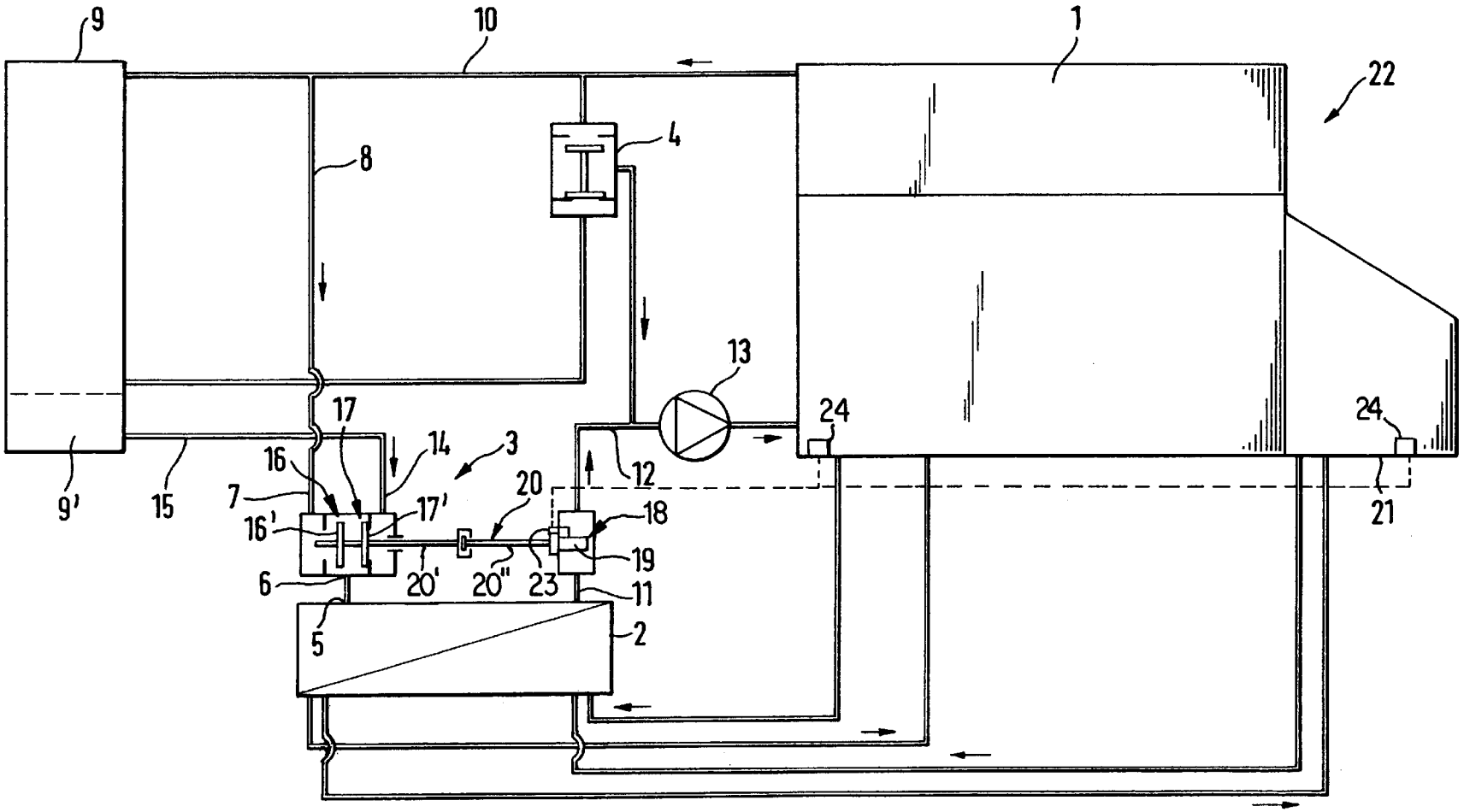
FIG. 1 schematically shows a heat exchanger according to a preferred embodiment of the present invention.

Referring to the drawings, a heat exchanger 2 is impacted on the one hand by coolant from an engine 1 and on the other hand by lubricating and transmission oil. The heat exchanger 2 is subjected at its inlet 5 to coolant flows at different temperatures for alternate heating and cooling of the oils under valve control. Valve device 3 located at the inlet is controlled as a function of the outlet temperature of one of the liquids.

As is known, the coolant in the engine 1 is circulated through the bypass during the warm-up phase by a thermostat 4 for rapidly warming the engine 1 to operating temperature.

In order to bring the engine 1 to operating temperature even more rapidly, its lubricating oil is supplied to heat exchanger 2, which during warm-up of engine 1, is subjected in the bypass to the coolant heated during bypass operation under valve control in engine 1 for rapid warm-up of the lubricating oil of engine 1. For this purpose, valve device 3, which is connected with a coolant inlet 5 from heat exchanger 2 through its outlet 6, is connected with its heating supply 7 through a line 8 with a section 10 that connects engine 1 with air/water heat exchanger 9. Passing through a coolant outlet 11 of water/oil heat exchanger 2, the coolant is supplied through a line 12 and a pump 13 to the bypass of engine 1. Valve device 3 also has a cold inlet 14 connected through a line 15 with a low-temperature cooler 9' of air/water heat exchanger 9.

To control the coolant flows at different temperatures through hot inlet 7 and cold inlet 14, valve device 3 comprises valves 16 and 17. These valves 16 and 17 can be operated separately, under the control of the characteristic map for example, by individual positioning motors $M_1$ and $M_2$, as shown in FIG. 2. Alternatively, a single positioning motor may be used, with the valves 16 and 17 being coupled together as in FIG. 1. The temperature sensor in FIG. 2 is an electrical or electronic temperature sensor. The positioning motors $M_1$ and $M_2$ are controlled by amplified signals from the temperature sensor 18.

Figure 2:
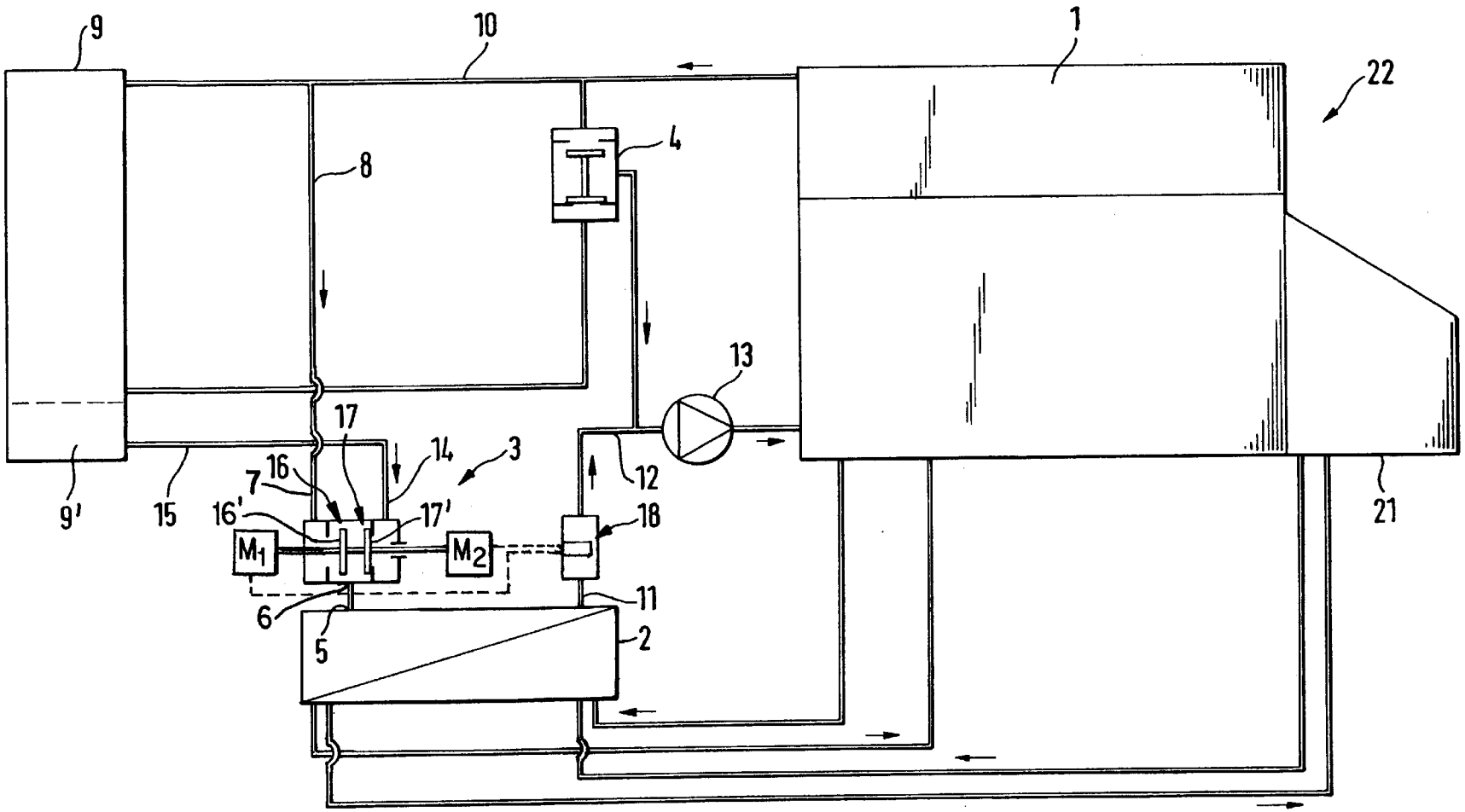
FIG. 2 schematically shows a heat exchanger according to another preferred embodiment of the present invention.

According to FIG. 1, valves 16 and 17 are operated jointly and are located a mutually fixed distance apart. As also shown in the drawings, valve 16 that controls hot inlet 7 and valve 17 that controls cold inlet 14 are moved into the closed position. This valve setting, which is conventional at the beginning of a warm-up phase of engine 1, must be changed under control as engine 1 warms up in such fashion that the hot coolant supplied through hot inlet 7 is mixed with the cold coolant supplied through cold inlet 14 by corresponding open positions of the two valves 16 and 17 in valve unit 3, so that the coolant supplied through outlet 6 to inlet 5 of heat exchanger 2 has a mixed temperature. The admixture of cold coolant increases in intensity directly with the temperature of the coolant supplied from line 10 through line 8 and hot inlet 7 from the bypass line of the engine, especially with the coolant temperatures of 100° C. and more under the control of the characteristic field.

To achieve high quality regulation of valve device 3 as well as a high temperature for the coolant that flows out of heat exchanger 2 through outlet 11 to avoid a delayed warm-up phase of engine 1, a temperature sensor 18 is located in outlet 11 of water/oil heat exchanger 2 for the coolant that serves for warming and cooling. The temperature sensor controls and/or regulates valves 16 and 17 of valve device 3 associated with hot inlet 7 and cold inlet 14. The advantage of the arrangement that locates temperature sensor 18 in outlet 11 of heat exchanger 2 is that the coolant flows, which are at different temperatures and which are brought together through valve device 3, are mixed thoroughly in heat exchanger 2 over long flow paths so that the temperature is relatively constant at outlet 11 of heat exchanger 2. When the lubricating and transmission oils are heated by means of heat exchanger 2, the coolant at outlet 11 is cooler than that at inlet 5, so that a much higher activation temperature for operating valves 16 and 17 can be selected with temperature sensor 18 located according to the invention. Because of the relatively constant mixing temperature in outlet 11 of heat exchanger 2, a high degree of regulating quality is achieved in conjunction with a relatively high selectable activation temperature of temperature sensor 18, as well as a relatively high temperature level for the coolant that flows in from outlet 11 through line 12 and pump 13 into the bypass circuit of engine 1 during warm-up.

To produce a valve device 3 with a simple design, a wax-filled expansion element 19 with a rod-type piston 20 is provided as a temperature sensor 18. Piston 20 has valve plates 16', 17' located at a distance from one another such that during each maximum stroke of piston 20, one valve plate 16' or 17' is in the open position and the other valve plate 17' or 16' is in the closed position. For further simplification of valve device 3, it is designed as a separate part with an outlet 6 located between valves 16 and 17, through which outlet valve device 3 can be tightly connected with inlet 5 of heat exchanger 2. A piston 20 designed as a combination of two sections 20', 20" connects valve unit 3 with expansion element 19 located in heat exchanger outlet 11.

Alternatively, the temperature sensor 18 may be an electrical or electronic sensor which sends signals to the positioning motors $M_1$, $M_2$.

As can be seen from the drawing, heat exchanger 2 controlled according to the invention also serves for alternate heating and cooling of the oil of a transmission 21, which forms a drive assembly 22 with engine 1.

Different oils of a drive assembly 22 can be warmed or heated or cooled through either a common water/oil heat exchanger 2 designed according to the invention or through a separate heat exchanger 2. A transmission heating/cooling concept of this kind can have its effect advantageously improved by equipping expansion element 19 with an electrical heating element 23 that can be controlled by signals from an additional temperature sensor 24 located in an oil sump of drive assembly 22. In this manner, the regulating temperature of valve device 3 can be displaced toward higher temperatures in order to achieve rapid heating of the oils in drive assembly 22 with almost no delay in the warm-up of engine 1.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A temperature adjustment system with liquid heat exchanger media in an internal combustion engine, having at least two different liquids in separate circuits, comprising:

a heat exchanger exposed on an inlet side to a plurality of flows of a first of said liquids, said flows being at different temperatures, for alternate heating or cooling of a second of said liquids under valve control, a valve device located on the inlet side being controlled as a function of a temperature of the first liquid on an outlet side of the heat exchanger, a thermostat in a bypass permitting the first of said liquids to pass by the heat exchanger and the valve device during an engine warm-up phase, and a temperature sensor located on the outlet side of the heat exchanger for control and/or regulation of separate valves of the valve device located in a hot inlet and a cold inlet for the first liquid in the valve device.

2. A system according to claim 1, wherein said temperature sensor comprises a wax-filled expansion element provided with a rod-type piston, said piston having valve plates mounted at a distance apart such that during each maximum stroke of said piston, one valve plate is in an open position and the other valve plate is in a closed position.

3. A system according to claim 1, wherein said valve device has an outlet located between the valves via which the valve device can be tightly connected with the inlet side of the heat exchanger, a piston composed of two connected sections connecting the valve device with an expansion element located said outlet side of the heat exchanger.

4. A system according to claim 3, wherein said first liquid is a coolant which flows through a coolant circuit of the internal combustion engine, said second liquid being an oil for a drive assembly, said hot inlet of the valve device being connected with said bypass, said cold inlet of the valve device being connected with a low-temperature cooler located in the coolant circuit.

5. A system according to claim 4, wherein said oil is a transmission oil.

6. A system according to claim 4, wherein said expansion element is equipped with an electrical heating element, said electrical heating element being controllable by signals from an additional temperature sensor located in an oil sump of said drive assembly.

7. A system according to claim 1, wherein the separate valves of the valve device are in a driving connection with at least one positioning motor either individually or in common, said valves being controlled by amplified signals from an electrical or electronic temperature sensor.

8. A cooling system for a motor vehicle, comprising:

a first heat exchanger having an inlet communicating with an internal combustion engine via a coolant return line;

a valve device having a hot inlet communicating with said coolant return line, and having a cold inlet communicating with an outlet of the first heat exchanger;

a second coolant/oil heat exchanger having a coolant inlet communicating with an outlet of the valve device, and having a coolant outlet communicating with the internal combustion engine via an engine coolant supply line;

a thermostat in a bypass permitting coolant to pass by the first heat exchanger, the valve device, and the second heat exchanger during a warm-up phase, and a temperature sensor disposed in said engine coolant supply line, said temperature sensor controlling said valve device to regulate a relative proportion of incoming coolant flow into said valve device from said hot inlet and from said cold inlet.

9. A cooling system according to claim 8, wherein said coolant/oil heat exchanger has at least one oil inlet and outlet communicated with at least one of the internal combustion engine and a transmission.

10. A cooling system according to claim 8, wherein said temperature sensor is a wax-filled expansion element which is coupled to said valve device via a rod-type piston.

11. A cooling system according to claim 8, wherein said valve device is controlled via at least one positioning motor coupled thereto, said temperature sensor providing an electrical signal to said at least one positioning motor.

12. A cooling system for a motor vehicle, comprising:

a valve device having a hot inlet communicating with a coolant return line from an internal combustion engine, and having a cold inlet communicating with a first heat exchanger;

a second coolant/oil heat exchanger having a coolant inlet communicating with an outlet of the valve device, and having a coolant outlet communicating with an engine coolant supply line;

a thermostat in a bypass permitting coolant to pass by the first heat exchanger, the valve device, and the second heat exchanger during a warm-up phase, and a temperature sensor disposed in said engine coolant supply line, said temperature sensor controlling said valve device to regulate a relative proportion of incoming coolant flow into said valve device from said hot inlet and from said cold inlet.

13. A method of controlling a cooling system for a motor vehicle including a first heat exchanger having an inlet communicating with an internal combustion engine via a coolant return line, a valve device having a hot inlet communicating with said coolant return line and a cold inlet communicating with an outlet of the first heat exchanger, a second coolant/oil heat exchanger having a coolant inlet communicating with an outlet of the valve device and a coolant outlet communicating with the internal combustion engine via an engine coolant supply line, and a thermostat in a bypass permitting coolant to pass by the first heat exchanger, the valve device, and the second heat exchanger during a warm-up phase, said method comprising:

arranging a temperature sensor in said engine coolant supply line; and controlling said valve device with said temperature sensor in order to regulate a relative proportion of incoming coolant flow into said valve device from said hot inlet and from said cold inlet.

14. A method according to claim 13, wherein said coolant/oil heat exchanger has at least one oil inlet and outlet communicated with at least one of the internal combustion engine and a transmission.

15. A method according to claim 13, wherein said temperature sensor is a wax-filled expansion element which is coupled to said valve device via a rod-type piston.

16. A method according to claim 13, wherein said valve device is controlled via at least one positioning motor coupled thereto, said temperature sensor providing an electrical signal to said at least one positioning motor.

* * * * *